US011574802B2

(12) United States Patent
Schwieters

(10) Patent No.: US 11,574,802 B2
(45) Date of Patent: Feb. 7, 2023

(54) MASS SPECTROMETER COMPENSATING ION BEAMS FLUCTUATIONS

(71) Applicant: Thermo Fisher Scientific (Bremen) GmbH, Bremen (DE)

(72) Inventor: Johannes Schwieters, Ganderkesee (DE)

(73) Assignee: FEI Company, Hillsboro, OR (US)

( * ) Notice: Subject to any disclaimer, the term of this patent is extended or adjusted under 35 U.S.C. 154(b) by 0 days.

(21) Appl. No.: 16/691,517

(22) Filed: Nov. 21, 2019

(65) Prior Publication Data

US 2020/0203139 A1 Jun. 25, 2020

(30) Foreign Application Priority Data

Dec. 21, 2018 (GB) ..... 1820962

(51) Int. Cl.
*H01J 49/26* (2006.01)
*H01J 49/02* (2006.01)
(Continued)

(52) U.S. Cl.
CPC ..... *H01J 49/0036* (2013.01); *H01J 49/0009* (2013.01); *H01J 49/025* (2013.01); *H01J 49/06* (2013.01)

(58) Field of Classification Search
CPC ... H01J 49/0009; H01J 49/0036; H01J 49/025
See application file for complete search history.

(56) References Cited

U.S. PATENT DOCUMENTS 5,302,827 A 4/1994 Foley
5,598,001 A * 1/1997 Flory ..... H01J 49/4215 250/282
(Continued)

FOREIGN PATENT DOCUMENTS

EP 2380186 A1 10/2011
EP 3401944 A1 11/2018
(Continued)

OTHER PUBLICATIONS

Extended Search Report dated Apr. 28, 2020 to EP Patent Application No. EP19215457.3, 7 pages.
(Continued)

*Primary Examiner* — Eliza W Osenbaugh-Stewart

(57) ABSTRACT

A mass spectrometer comprises an interface for receiving an ion beam from an ion source, a mass analyzer unit for selecting from the received ion beam, in two or more time periods, ions having different ranges of mass-to-charge ratios, a first detection unit for detecting, in each of said time period, ions within a selected range and producing first detection signals representative of quantities of detected ions having respective mass-to-charge ratios, and a second detection unit arranged between the interface and the mass analyzer unit for producing a second detection signal representative of a total intensity of the ion beam received from the ion source as a function of time. The mass spectrometer further comprises a processing unit for normalizing the first detection signals by using the second detection signal, which processing unit may output a ratio of normalized first detection signals.

20 Claims, 5 Drawing Sheets

(51) Int. Cl.
*H01J 49/00* (2006.01)
*H01J 49/06* (2006.01)

(56) References Cited

U.S. PATENT DOCUMENTS

| | | | | |
|---|---|---|---|---|
| 9,324,547 | B2 | 4/2016 | Hauschild et al. | |
| 2012/0305758 | A1 | 12/2012 | Park | |
| 2013/0009051 | A1 | 1/2013 | Park | |
| 2014/0217272 | A1 | 8/2014 | Ramer et al. | |
| 2018/0308674 | A1 | 10/2018 | Schwieters et al. | |
| 2019/0206665 | A1* | 7/2019 | Cleland ..... | H01J 49/0031 |

FOREIGN PATENT DOCUMENTS

| | | | |
|---|---|---|---|
| JP | H086036 | A | 1/1996 |
| JP | H11185698 | A | 7/1999 |
| JP | 2001057174 | A | 2/2001 |
| JP | 2002518810 | A | 6/2002 |
| JP | 2007278934 | A | 10/2007 |
| JP | 2012515999 | A | 7/2012 |

OTHER PUBLICATIONS

GB Combined Search and Examination Report dated Jun. 19, 2019, to GB Patent Application No. 1820962.7.

Bazhenov et al., "Gas-Dynamic Fluctuations and Noises in the Interface of an Atmospheric Pressure Ionization Ion Source," *Journal of Analytical Chemistry*, 2011, vol. 66, No. 14, pp. 1392-1397.

Notice of Refusal dated Dec. 3, 2020, to JP Patent Application No. 2019-230497.

Search Report dated Nov. 5, 2020, to JP Patent Application No. 2019-230497.

* cited by examiner

MASS SPECTROMETER COMPENSATING ION BEAMS FLUCTUATIONS

CROSS-REFERENCE TO RELATED APPLICATIONS

This application claims the priority to GB Patent Application No. 1820962.7, filed on Dec. 21, 2018, which application is hereby incorporated herein by references in its entirety.

FIELD OF THE INVENTION

The present invention relates to a mass spectrometer and to a method of operating a mass spectrometer. More in particular, the present invention relates to a mass spectrometer in which the mass-to-charge ratios of the ions of an ion beam are detected sequentially.

BACKGROUND OF THE INVENTION

High precision elemental and isotopic abundance measurements are important for applications in environmental, geological, nuclear and forensic sciences. There are several applications in which high precision isotope and elemental abundance measurements are the key indicator, for example:

- The precise and accurate knowledge of the elemental and/or the isotopic composition of a sample is an important tracer with respect to forensic sciences. The elemental and isotopic composition of a sample is unique to certain locations.
- The relative abundances of certain elements give insight into geological or nuclear processes indicating for instance the age and the generation of the sample material during the history of the earth, or even the evolution of the solar system during the nucleosynthesis process at the formation of the universe.
- The distribution of the noble gases in the atmosphere is a tracer for the global temperature of the oceans and the atmosphere. The dilution of the different noble gas species in the ocean water and in the atmosphere is temperature dependent and thus the precise and accurate knowledge of the noble gas abundances dissolved in the sea water is an important tracer to trace back recent global temperature changes related to climate change.
- Precise and accurate knowledge of the elemental and isotopic composition are key indicators to monitor nuclear processes and contaminations in the environment as well as in industrial processes.

Mass spectrometry is an important analytical technology applied to the measurement of elemental and isotopic abundances of all elements across the periodic table. Prior to the detection of the elemental and isotopic species a sample has to be ionized. In case the sample is a gas it can be introduced directly into the ion source of the mass spectrometer and usually is ionized by an electron impact ionization source. Examples of these instruments are for instance the Thermo Scientific™ DFS™ mass spectrometer or the Thermo Scientific™ 253 Ultra™ mass spectrometer.

Solid samples can be directly eroded and ionized by a low-pressure glow discharge plasma ion source. For more details refer to the Thermo Scientific™ Element GD™ mass spectrometer (www.thermofisher.com).

Most commonly solid samples are dissolved and separated in several sample preparation steps which result in a liquid acidic solution. This acidic solution can be injected through a nebulization system into the atmospheric plasma of an inductively coupled plasma (ICP) ion source. Through an atmosphere-to-vacuum interface the ions enter into the mass analyzer for mass spectral analysis and quantification. Examples of spectrometers that utilize this technique include the Thermo Scientific™ Element 2™ mass spectrometer and the Thermo Scientific™ NEPTUNE Plus™ mass spectrometer.

For high precision isotope ratio measurements, the multi-collector approach is advantageous where all species of interest are detected in parallel and simultaneously. An important advantage of the simultaneous multi-collector approach is that any signal fluctuations caused by fluctuations in the ion generation process or any fluctuations caused by the sample delivery occur in parallel on all detectors. As these fluctuations appear on all detectors at the same time, they do not affect the calculation of the relative abundance ratios of the different species which are detected simultaneously.

Ion source fluctuations can occur for multiple reasons, e.g.:

In case of an electron impact ionization source: fluctuations due to instabilities in the filament current regulation which controls the intensity of the ionizing electron beam. These fluctuations can be due to limitations of the electronic filament regulator or due to fluctuations of the electron emission from filaments at high gas pressures.

- Plasma flicker in case of inductively coupled plasma (ICP) ionization or glow discharge ionization (GD).
- Fluctuations of the efficiency of a thermal ionization source due to small temperature fluctuations on the filament or erratic sample migration on the filament surface.
- Droplet generation during the nebulization process for a liquid sample in case of ICP (inductively coupled plasma) ionization.
- Transient signals when coupling to a chromatographic device, such as a device for liquid chromatography (LC) or gas chromatography (GC).
- Transient signals due to laser ablation of the sample and online coupling to an ICP source
- For accurate isotope and elemental abundance measurements, proper calibration is necessary. Usually this is achieved by suitable standard and reference materials and by elaborate calibration schemes.

In particular for high precision isotope ratio measurements a special type of mass spectrometer has been developed which comprises a sector field mass spectrometer coupled to a multi-collector detector array (as in the Thermo Scientific™ NEPTUNE Plus™ mass spectrometers). The sector field mass analyzer spatially separates the different masses along the focal detector plane of the ion optics. Along this detector plane an array detector catches the ion beam intensity for all ion beams in parallel. With respect to precision and accuracy the most advantageous feature of this arrangement is that all fluctuations of the ion beam intensity due to fluctuations in the sample delivery or due to fluctuations generated in the ion source occur simultaneously on all detected species and thus cancel for the relative abundance measurement of the detected species. This leads to a major improvement in precision for multi-collector instruments compared to sequential mass spectrometers where the species of interest can be measured by a technique called scan mode or peak jumping mode, which is applied across a certain mass range (e.g. scan mode) and/or all species of interest (e.g. peak jumping across discrete peaks) or a combination of those modes. Thus, the measured abundances are biased by the individual fluctuations of the measured species because they are detected at different points in time.

An example of a mass spectrometer which is provided with multiple parallel detection units is disclosed in US 2018/0308674, which is herewith incorporated by reference. The mass spectrometer of US 2018/0308674 comprises a plurality of ion detectors for detecting a plurality of different ion species in parallel and/or simultaneously. The detector arrangement of the known mass spectrometer may consist of, for example, nine ion detectors in parallel, allowing nine detections to take place substantially simultaneously. Each detector of the known detector arrangement can include a Faraday cup.

Although multi-detector mass spectrometers are very effective for certain applications, the relative mass range of such devices is for practical reasons limited to about 20%, i.e. from mass 40 amu (atomic mass unit) to 48 amu. This simultaneous relative mass range is sufficient to measure in parallel isotope abundances of one element at a time. However, it is not sufficient to measure elemental ratios covering a wider mass range. For instance, the relative abundances of the noble gases argon and xenon would need to simultaneously cover the mass range from $^{36}Ar$ to $^{134}Xe$, which corresponds to a relative mass range for this application of more than 370% (as 134/36=3.72).

In summary, the prior art is faced with the problem that an arrangement of multiple parallel detectors necessarily has a limited mass-to-charge range, while an arrangement which has a large mass-to-charge range by using a single detector sequentially suffers from inaccuracies due to fluctuations of the ion beam.

SUMMARY OF THE INVENTION

To solve this problem of the prior art, the present invention provides a mass spectrometer comprising:

- a mass analyzer unit for selecting from an ion beam, in two or more time periods, ions having different ranges of mass-to-charge ratios,
- a first detection unit for detecting, in each of said time periods, ions within a respective selected range of mass-to-charge ratios and producing first detection signals representative of quantities of detected ions having the respective ranges of mass-to-charge ratios,
- a second detection unit for producing a second detection signal representative of a total intensity of the ion beam as a function of time, and
- a processing unit for normalizing the first detection signals by using the second detection signal.

By providing a second detection unit, it is possible to determine the intensity of the ion beam as a function of time and to produce a second detection signal representing this intensity. The second detection signal can be produced simultaneously with the first detection signals, that is, during the time periods in which the ions of different mass-to-charge ratios are being selected by the mass analyzer unit and detected by the first detection unit.

By using this second detection signal representing the ion beam intensity, the detection signals produced by the first detection unit can be normalized. That is, the detection signals sequentially produced by the first detection unit can be effectively compensated for any fluctuations in the ion current. As a result, a normalized detection signal is obtained which is independent of any fluctuations in the ion beam. Thus, due to the invention the advantageous wide mass-to-charge ratio of sequential detection can be used without the disadvantage of inaccuracies due to any fluctuations in the ion beam.

It is noted that using an additional detection unit in a mass spectrometer is known per se, but for very different purposes. US 2004/0217272, for example, discloses a method for controlling an ion population to be analyzed in a mass spectrometer. An additional detector is used to determine the accumulation rate of ions during sampling intervals prior to the injection of the ions into the mass spectrometer. The detection of the additional detector and the signal acquisition in the mass spectrometer are sequential, not simultaneous. This known method therefore relates to a discontinuous use of the mass spectrometer, while the mass spectrometer of the present invention is suitable for continuous use and does not require sequential sampling intervals. Furthermore, the signal of the addition detector of the prior art is not used to normalize the detection signal representing the output of the mass analyzer.

U.S. Pat. No. 9,324,547 discloses a mass spectrometer in which batches of ions are accumulated in a mass analyzer. The number of ions per batch is controlled based upon a measurement of an ion current obtained using an independent detector located outside the mass analyzer. This known mass spectrometer is also used in a discontinuous manner.

In contrast, the mass spectrometer of the present invention can work in a continuous manner, allowing an ion beam to be analyzed virtually uninterruptedly, while detecting the mass separated ion species at the same time. That is, the mass spectrometer of the present invention is designed to compensate ion beam fluctuations rather than to estimate ion accumulation rates. The mass spectrometer of the present invention can operate without accumulating batches of ions prior to detection.

It is further noted that the article "Gas-Dynamic Fluctuations and Noises in the Interface of an Atmospheric Pressure Ionization Ion Source" by A. N. Bazhenov et al., Journal of Analytical Chemistry, 2011, Vol. 66, No. 14, discloses the use of an oscilloscope to measure the skimmer current in a mass spectrometer so as to determine the fluctuations of the total ion current to the skimmer. The measured skimmer current is used to determine the frequency spectrum of the ion current noise, which can be compared with the frequency spectrum of gas dynamic noises. The article does not suggest using the ion current fluctuations for any other purposes. In addition, the present invention does not use frequency spectra but uses time domain signals.

In an embodiment of the mass spectrometer of the present invention, the processing unit is further configured for producing a ratio of normalized first detection signals. The processing unit may still further be configured for outputting at least one of the normalized first detection signals and a ratio of normalized first detection signals. That is, after the processing unit has normalized the first detection signals which represent quantities of detected ions, a ratio of normalized detection signals may be determined and may be output. Such ratios represent the relative quantities of ions, compensated for any fluctuations in the ion beam.

In an embodiment of the mass spectrometer of the present invention, the processing unit of the mass spectrometer is configured for normalizing the first detection signals by dividing each first detection signal by the second detection signal at a corresponding time period. That is, by determining the ratios of the first detection signal (at different points in time) and the second detection signal (at substantially corresponding points in time), the influence of any fluctuations in the ion beam is effectively eliminated. Instead of dividing, other operations may be used, such as subtracting the second detection signal from the first detection signal in corresponding time periods. To prevent negative subtraction results, the second detection signal may be reduced before subtraction, for example by multiplying the second detection signal values with a fixed factor of, for example, 0.1, or by a variable factor which may depend on the amplitude of the second and/or the first detection signals.

In an embodiment, the mass spectrometer comprises a single first detection unit while the single first detection unit comprises a single detector (which may be referred to as first detector as it is associated with the first detection unit). As the mass spectrometer according to the invention is based on sequential detection, a single detector may suffice. However, in some applications, more than one detector may be used in a single detection unit, for example two, three, four or even more, to utilize detectors having different properties, such as different sensitivities, for example. These multiple detectors may be used sequentially and/or cyclically.

In an embodiment, the mass analyzer unit is configured for continuously selecting ions in consecutive time periods. That is, the ion selection in the mass spectrometer of the present invention may be continuous, in contrast to the ion selection in some prior art mass spectrometers, where ions are processed in batches. The above-mentioned patent documents US 2004/0217272 and U.S. Pat. No. 9,324,547 provide examples of processing ions in batches, that is, discontinuously.

The second detection unit may comprise a single detection element or multiple detection elements, each of which may be provided with an opening for passing the ion beam therethrough. The second detection unit may comprise a detection circuit for deriving the second detection signal from an electrical current generated in one or more detection elements by ions from the ion beam, for example but not limited to scattered ions from the ion beam. The at least one detection element of the second detection unit may be arranged upstream of the mass analyzer so as to detect the ions of the full ion beam before a range of ions is selected by the mass analyzer.

The detection element or elements, which in some embodiments may comprise a detection plate, may be constituted by a sampler cone, a skimmer cone, an entrance slit, an aperture, an ion lens or a similar object. The detection element may in some embodiments comprise a Faraday cup.

The mass spectrometer according to the invention may further comprise an ion source for producing the ion beam. Several types of ion sources may be used. For example, a plasma source, a thermal ionization source, or an electron impact source. In embodiments comprising a plasma source, the device may further comprise ion optics and/or a pre-mass filter unit, arranged upstream of the mass analyzer, for removing plasma gas ions. Such a pre-mass filter unit may comprise a quadrupole, and/or may be arranged as a notch filter to substantially block a narrow range of interfering ions while letting other ions pass. A collision and/or reaction cell may additionally or alternatively be used to remove plasma gas ions.

In case the mass spectrometer comprises an additional filter unit, such as a collision/reaction cell and/or a pre-mass filter unit for filtering plasma gas ions as mentioned above, the detector element of the second detection unit may be arranged between the pre-mass filter unit and the mass analyzer unit, that is, downstream of the pre-mass filter unit and upstream of the mass analyzer unit. This has the advantage that the second detection signal is substantially not influenced by plasma gas ions. In other embodiments, however, the detector element of the second detection unit may be arranged upstream of the plasma ion filter unit.

The ion beam may be the output of a gas chromatography (GC) flow, a liquid chromatography (LC) flow, a gas stream of a laser ablation cell or gas from a gas container.

As mentioned above, the mass spectrometer may comprise a pre-mass filter unit arranged upstream of the mass analyzer unit, in particular between the interface of the mass spectrometer where the ion beam is received and the mass analyzer unit. Such an additional filter unit may serve to select a certain mass-to-charge range from the ion beam while rejecting other mass-to-charge ranges. In an embodiment having a plasma ion source, the pre-mass filter unit may be used to reject plasma gas ions from the ion beam. In embodiments using a GC coupling or an inductively coupled plasma (ICP), a pre-mass filter unit can remove helium ions or argon ions respectively, to avoid the mass spectrum being dominated by these gases.

The pre-mass filter unit may comprise a quadrupole unit, but other pre-mass filter units can also be envisaged, for example a hexapole unit. Such a pre-mass filter unit may be used independently of the type of ion source. The second detection unit may, depending on the location of the associated detection element, produce a second detection signal with is representative of the original ion beam received at the interface of the mass spectrometer, or of a filtered ion beam from which for example plasma ions and/or other undesired ions have been removed. The detection element of the second detection unit may therefore be arranged upstream or downstream of the pre-mass filter unit but will typically be arranged upstream of the mass analyzer unit.

Instead of, or in addition to a pre-mass filter, the mass spectrometer may comprise a collision cell. Such a collision cell may be arranged between the pre-mass filter (if present) and the second detection unit, that is, downstream of the pre-mass filter and upstream of the second detection unit.

In case a pre-mass filter and/or a collision cell is used, the intensity of the ion beam measured will depend on the location of the detection element of the second detection unit. Upstream of any pre-mass filter and/or collision cell, the second detection unit will measure the original total ion beam intensity. Downstream of any pre-mass filter and/or collision cell, the second detection unit may measure a reduced total ion beam intensity corresponding to the mass window of the pre-mass filter and/or collision cell. Such a mass window may be wider than the sum of the ranges of mass-to-charge ratios selected by the mass analyzer. The total ion beam intensity may be equal to the ion beam intensity immediately prior to the mass analyzer where the ion beam includes at least all ranges of mass-to-charge ratios to be selected by the mass analyzer.

The present invention also provides a method of operating a mass spectrometer comprising:

- receiving an ion beam from an ion source,
- selecting from the received ion beam, in two or more time periods, ions having different ranges of mass-to-charge ratios,
- detecting, in each of said time periods, ions within a respective selected range of mass-to-charge ratios and producing first detection signals representative of quantities of detected ions having respective ranges of mass-to-charge ratios,
- detecting, in each of said time periods, a total intensity of the ion beam prior so as to produce a second detection signal, and
- normalizing the first detection signals by using the second detection signal.

The second detection signal may be a continuous (analogue or digital) time signal which represents the ion beam intensity. The second detection signal may be produced only during the time periods in which ions are selected and detected by the first detection unit but may be produced also outside those time periods. In some embodiments, the second detection signal may be constituted by or converted into a single value, representing the ion beam intensity during a certain time period. Similarly, in some embodiments the first detection signal may be constituted by a single value, representing the quantity of detected ions during a certain time period. When at least one of the first detection signal and the second detection signal is a continuous signal, an average value of the respective signal during the time period may be calculated and used for normalizing.

Normalizing the first detection signals may comprise dividing each first detection signal by the second detection signal at a corresponding time period. In some embodiments, this may comprise dividing a single value representing the first detection signal during a time period by another single value representing the second detection signal during that particular time period. In other embodiments, several values representing the first detection signal during a time period may be divided by corresponding values representing the second detection signal during that particular time period, where those values may correspond with different points in time during a time period. In still other embodiments, a continuous first detection signal may be divided by a continuous second detection signal at all available points in time (for example time samples) during a time period.

The method may further comprise dividing a normalized first signal corresponding with a first time period by a normalized first detection signal corresponding with a second, different time period to obtain a normalized intensity ratio, in particular, a normalized intensity ratio of the ions. That is, the intensity ratio of ions of two or more selected mass-to-charge ratio ranges may be determined by dividing the normalized first detection signals of the corresponding time periods. By using normalized (first) detection signals, the influence of any fluctuations in the ion beam is virtually eliminated.

The method of the invention may therefore comprise producing a ratio of normalized first detection signals. Additionally, the method of the invention may comprise outputting the ratio of normalized detection signals. The method may still further comprise continuously selecting ions in consecutive time periods. The method may yet further comprise removing plasma gas ions prior to selecting, in two or more time periods, ions having different ranges of mass-to-charge ratios.

The present invention additionally provides a computer program product for carrying out the method described above. The computer program product may comprise a tangible carrier on which instruction are stored which allow a processor to carry out the method steps according to the invention. The tangible carrier may include a portable memory device such as a DVD or a USB stick, or a non-portable memory device, for example one that is part of the processing unit.

DETAILED DESCRIPTION OF THE DRAWINGS

The present invention is aiming to improve existing mass spectrometers, in particular those for high precision isotope and elemental abundance measurements, so as to cover a larger mass range in applications in which using multiple parallel detectors does not provide a sufficiently large mass-to-charge range. The present invention allows single collector detections and/or measurements to be made while preserving the advantages of multi-collector detections and/or measurements, in particular the elimination of intensity fluctuations on determining the mass-to-charge ratio of two or more ion species.

Figure 1:
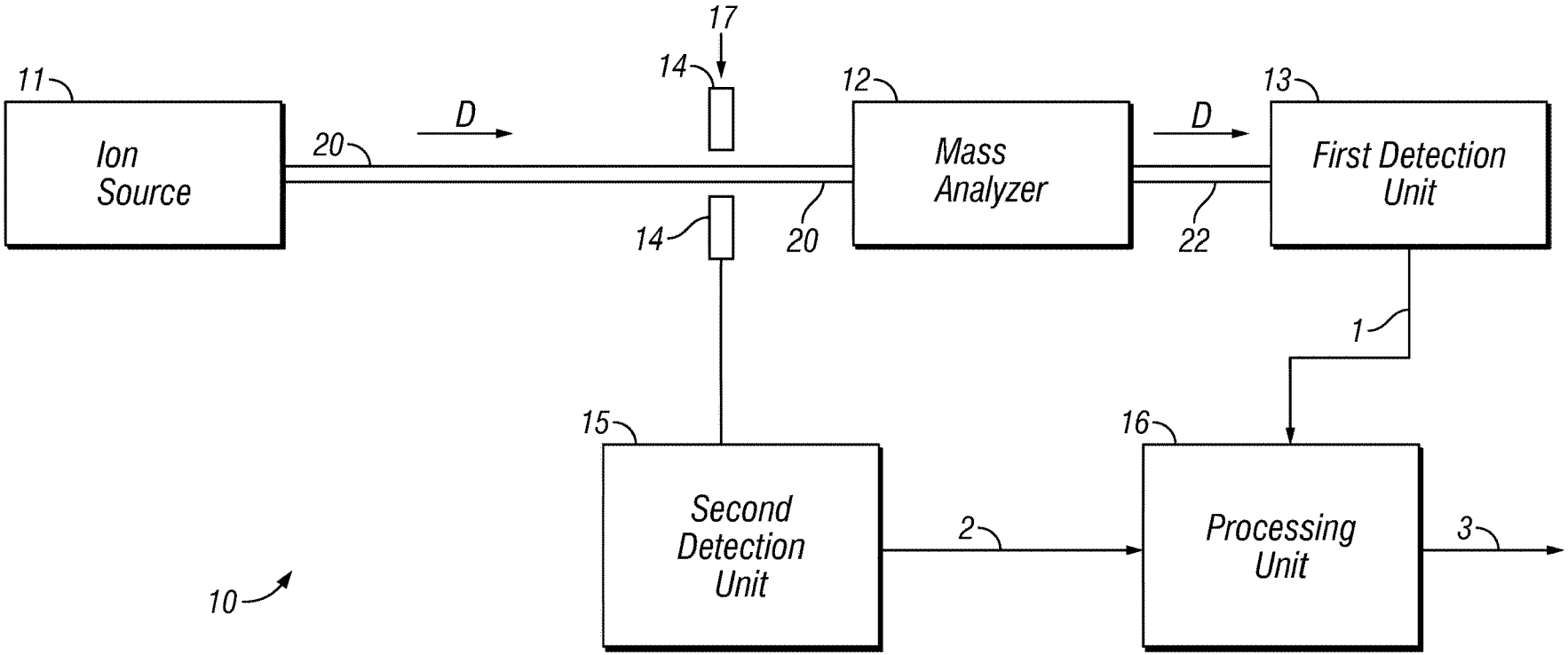
FIG. 1 schematically shows a first exemplary embodiment of a mass spectrometer according to the present invention.

The exemplary mass spectrometer 10 schematically illustrated in FIG. 1 is shown to comprise an ion source 11, a mass analyzer 12, a first detection unit 13, a second detection unit 15 comprising a detection element 14, and a processing unit 16. In the embodiment of FIG. 1, the detection element 14 constitutes the interface 17 between the ion source 11 and the other parts of the mass spectrometer 10 and may for example be constituted by a sampler cone. In other embodiments, this interface 17 may be constituted by another part, such as a skimmer cone, or an entrance aperture or slit, or by a dedicated detection element which may for example be ring-shaped or disc-shaped.

The ion source 11 can be a conventional ion source, such as an ICP (Inductively Coupled Plasma) source, a glow discharge source, an electron ionization source, a secondary ion ionization source, a thermal ionization source or any other suitable ion source. It is noted that a mass spectrometer may be supplied without an ion source, and that an ion source may be supplied separately, for example for subsequent assembly with the mass spectrometer. In FIG. 1 the ion source 11 is shown as part of the mass spectrometer 10.

The mass analyzer 12 can be a conventional mass analyzer, such as a quadrupole mass analyzer or a sector field mass analyzer (e.g. a magnetic sector and/or electric sector mass analyzer), which allows a continuous mass filtering of ions. The first detection unit 13 can be a conventional detection unit comprising a single ion detector, such as a Faraday cup. In some embodiments, the first detection unit 13 may comprise two or more detectors (e.g. Faraday cup and Secondary Electron Multiplier—SEM), which may be optimized for different mass-to-charge ratios. The first detection unit 13 is configured for producing first detection signals representative of quantities of detected ions. As these ions have been filtered by the mass analyzer 12, the detected ions will have a mass-to-charge ratio, or a range of mass-to-charge ratios corresponding with the ratio or range selected by the mass analyzer. The first detection signals 1 are output to the processing unit 16.

As illustrated in FIG. 1, an original ion beam 20 produced by the ion source 11 can pass through the detection element 14 to the mass analyzer 12 which filters the ion beam. As a consequence, a filtered ion beam 22 consisting of ions having a limited range of mass-to-charge values leaves the mass analyzer 12 and reaches the first detection unit 13, where the ions are detected. The direction D in which the ions travel, from the ion source 11 to the first detection unit 13, causes the first detection unit 13 to be located downstream of the mass analyzer 12 and, conversely, causes the mass analyzer 12 to be located upstream of the detection unit 13.

The detection element 14 may be constituted by a suitable object having at least one through opening for passing the ion beam 20. The detection element 14 may comprise a sampler cone, a skimmer cone, ion optics, or an object specifically designed for this purpose, such as a ring-shaped object or a set of plates arranged in parallel with the ion beam 20. The detection element 14 is electrically connected to a detection circuit of the second detection unit 15. The detection element 14 can be electrically conductive so as to allow a current to flow from the detection element 14 to the second detection unit 15 (or vice versa). This current is caused by a portion of ions from the ion beam 20 hitting the detection element 14. In an embodiment, ions in a peripheral portion of the ion beam hit the detection element 14. If the detection element 14 is constituted by a skimmer cone, for example, between 10% and 20% of the ions of beam 20 may hit the detection element 14 and thus contribute to the current supplied to the second detection unit 15. The actual percentage can depend on the width and focus of the ion beam, and on the diameter and/or position of the opening in the detection element.

The second detection unit 15 can comprise a detection circuit for deriving the second detection signal from an electrical current generated in the detection element 14 by the portion of the ions from the ion beam. This second detection signal 2, which represents the intensity of the ion beam, is also output to the processing unit 16.

The processing unit 16 can comprise one or more microprocessors, a memory and suitable I/O (Input/Output) circuits. The memory can contain instructions which allow the microprocessor(s) to carry out a method according to the invention. More in particular, the (at least one) microprocessor can normalize the first detection signals 1 by using the second detection signal 2 and can output normalized first detection signals 3. The microprocessor of the processing unit 16 may normalize the first detection signals by dividing each first detection signal by the second detection signal at a corresponding time period. The normalization process will later be explained in more detail with reference to FIGS. 4A-4C.

Figure 2:
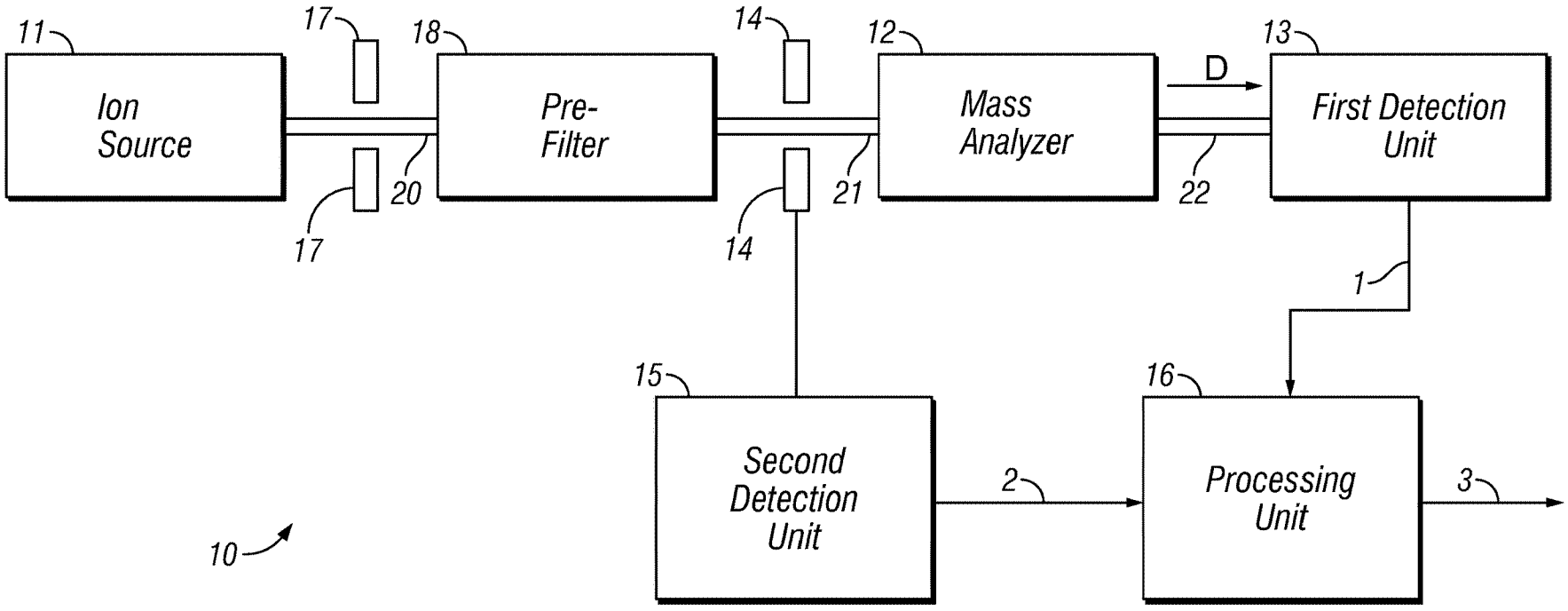
FIG. 2 schematically shows a second exemplary embodiment of a mass spectrometer according to the present invention.

The exemplary mass spectrometer 10 illustrated in FIG. 2 is shown to also comprise an ion source 11, a mass analyzer 12, a first detection unit 13, a detection element 14, a second detection unit 15 and a processing unit 16. In addition, the mass spectrometer of FIG. 2 comprises a pre-filter (which may also be referred to as pre-mass filter or mass pre-filter) 18. In the embodiment of FIG. 2, the interface 17 comprises an element separate from the detection element 14. The interface 17 of FIG. 2 typically comprises an aperture and may be constituted by a sampling cone or a skimmer cone, for example, in which case the detection element 14 may be constituted by ion optics, an entrance slit, or by a dedicated detection element, such as a detection ring or detection tube, preferably made of metal. The original ion beam 20 passes through the pre-filter 18 to become the pre-filtered ion beam 21, which in turn passes through the mass analyzer 12 to become the filtered ion beam 22 consisting of ions having a limited range of mass-to-charge values. This filtered ion beam 22 is detected by the first detection unit 13.

The mass pre-filter 18 may comprise a quadrupole filter, a Wien filter, a collision-reaction cell, ion optics or any other suitable filter. In particular when a plasma ion source is used, as in the case of ICP-MS (Inductively Coupled Plasma Mass Spectrometry), the pre-filter 18 may serve to remove matrix (e.g. plasma gas) ions, such as argon ions, from the ion beam. Advantageously, this enables the ion beam that is detected by the second detector and used as a measure of total ion beam intensity to comprise mostly or substantially ions from the sample and not, for example, from the plasma gas.

The other units of the mass spectrometer 10 of FIG. 2 may be similar to those of the mass spectrometer of FIG. 1.

The invention will further be explained with reference to FIGS. 3A-3B and FIGS. 4A-4C. As mentioned above, it can be advantageous to detect multiple different ion types substantially simultaneously using multiple parallel detectors, each detector being arranged for detecting a particular ion type or limited ion type range. In this so-called multi-collector approach, any fluctuations in the ion beam intensity will appear at all detectors substantially simultaneously and will therefore be cancelled out when calculating relative ion counts. Due to physical limitations, however, the multi-collector approach only allows a limited (approx. 20%) range of mass-to-charge ratios. This is clearly insufficient for determining the relative abundances of argon and xenon, for example, where a mass-to-charge ratio of approx. 370% is required.

Figure 3A:
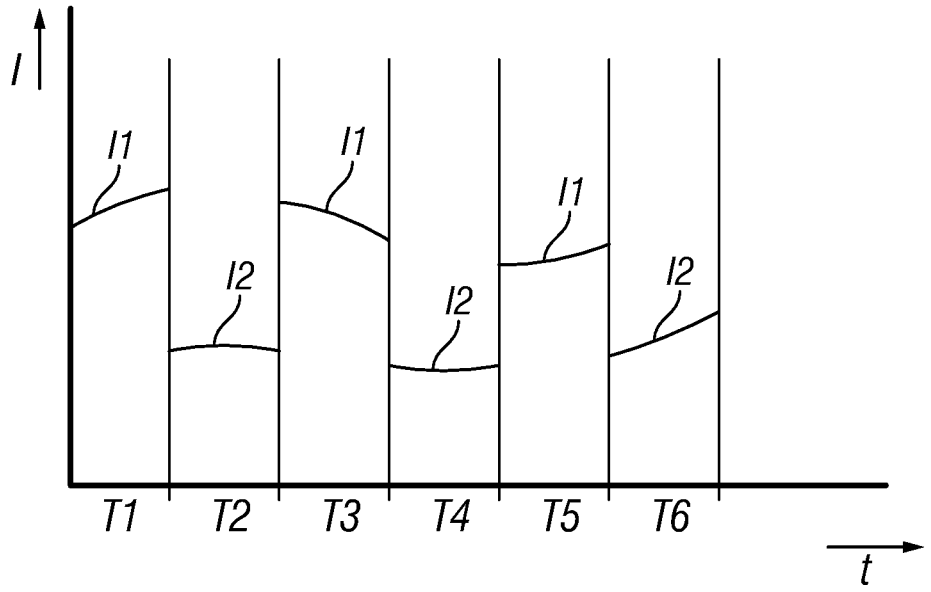
FIGS. 3A-3B schematically show examples of sequentially determined detector signals according to the prior art.

FIG. 3A schematically shows detected intensities I of individual ions species (or limited mass-to-charge ranges), detected by a single detector, as a function of time t. Detections take place in subsequent time periods T1, T2, etc. In time periods T1, T3 and T5, the (first) intensity I1 of a first ion species is detected, while in time periods T2, T4 and T6, the (second) intensity I2 of a second ion species is detected. Due to fluctuations in the ion beam, the detected intensities are not constant.

Figure 3B:
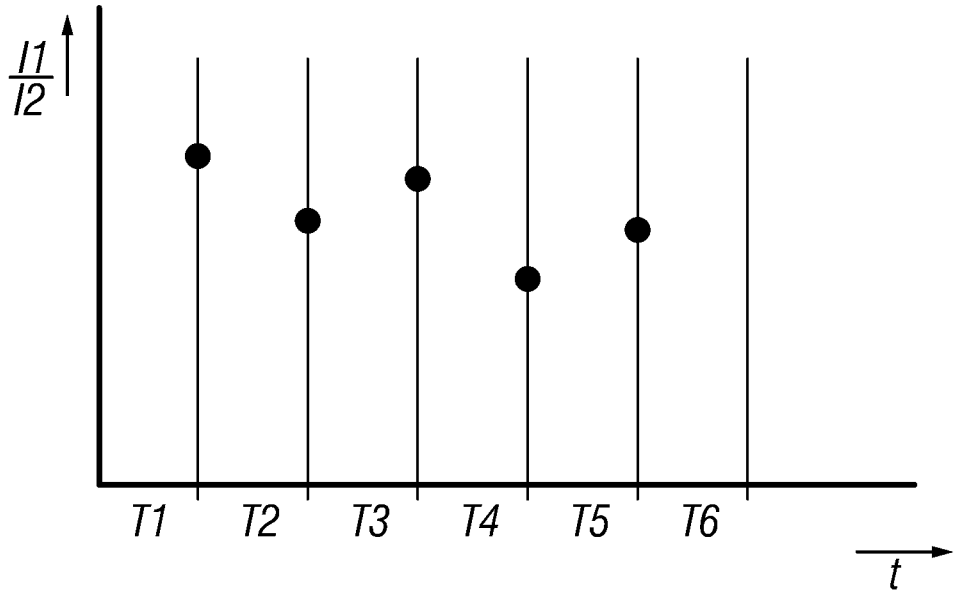
Figure 4A:
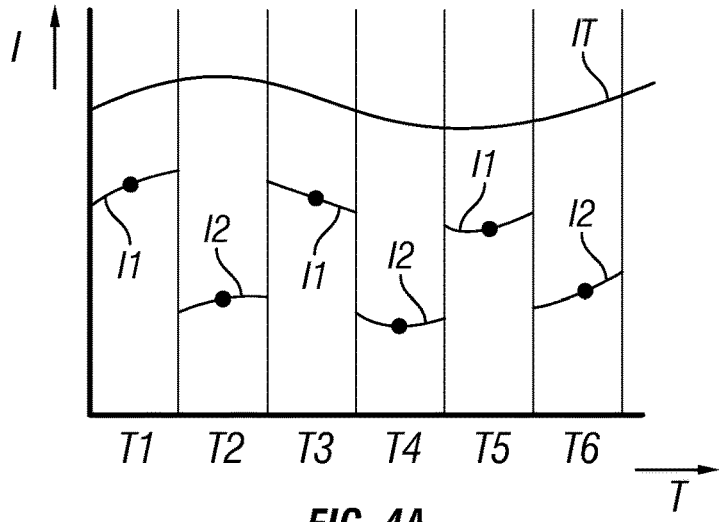
FIGS. 4A-4C schematically show examples of sequentially determined detector signals according to the present invention.
Figure 4B:
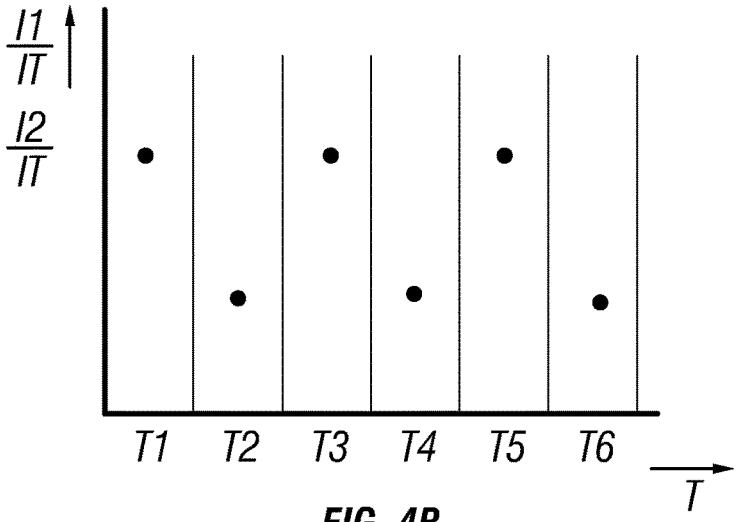
Figure 4C:
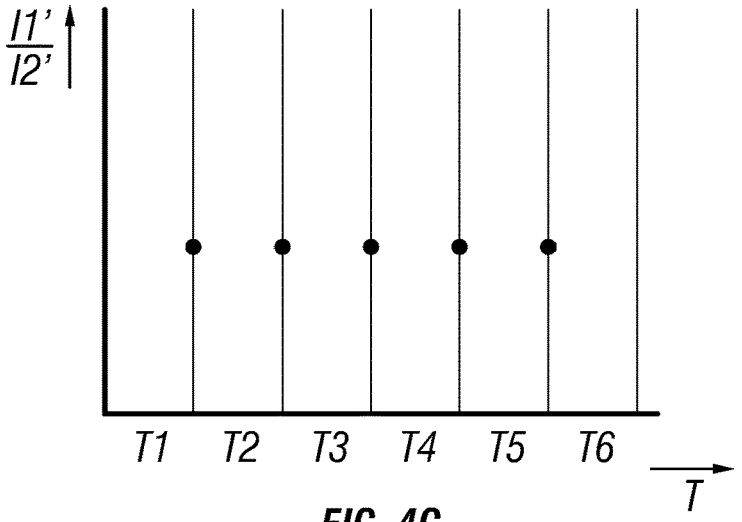

While FIGS. 3A-3B show ion intensities processed in accordance with the prior art, FIGS. 4A-4C show ion intensities processed in accordance with the invention.

The calculated ion ratios are schematically illustrated in FIG. 3B. These ratios may be calculated, for example, by dividing the average value of the first intensity I1 during the first time period T1 by the average value of the second intensity I2 during the second time period T2, resulting in an ion ratio for the combined time period T1+T2, shown in FIG. 4B at time t=(T1+T2)/2. Instead of an average value of the intensity during a time period, a median value could be used, or the intensity value in the middle of the respective time period. Similarly, ion ratios for the combined time periods T3+T4, T5+T6 etc. can be determined. Additionally, intermediate ion ratios for the combined time periods T2+T3, T4+T5 etc. can be determined in a similar manner. As can be seen in the example of FIG. 3B, these calculated ratios vary over time, thus making the ratios less reliable.

The present invention offers a solution to this problem by detecting the intensity of the total ion beam and using this detected total intensity to determine the individual ion intensities and ion ratios. This is schematically illustrated in FIGS. 4A-4C.

In FIG. 4A, the first ion intensity I1 and second ion intensity I2 are shown at time periods T1, T2 etc., as in FIG. 3A. It is noted that, as in FIG. 3A, the intensities I1, I2 etc. are functions of time and may therefore be written as I1(*t*), I2(*t*), etc. In accordance with the invention, FIG. 4A also shows a total ion intensity IT, which may be represented by the second detection signal (2 in FIGS. 1 and 2). The total ion intensity IT is also a function of time and may therefore be written as IT(t).

In the example of FIG. 4A, the total ion intensity IT, which may correspond with the intensity of the ion beam (20 in FIGS. 1 & 2) before it enters the mass analyzer (12 in FIGS. 1 & 2), is not constant over time but fluctuates. As a result, the first and second detected ion intensities I1 and I2, which may be represented by the first detection signals (1 in FIGS. 1 and 2), vary over time. However, in accordance with the present invention, the fluctuations of the detected ion intensities are compensated. This can be achieved by normalizing the first detection signals representing the detected ion intensities by using the second detection signal representing the total ion beam intensity. In particular, normalizing the first detection signals may be carried out by dividing each first detection signal by the second detection signal at a corresponding time period.

In the present example, the corresponding time period is the same time period: the first detected ion intensity I1 in time period T1 is divided by the total ion intensity IT in time period T1. Similarly, the second detected ion intensity I2 in time period T2 is divided by the total ion intensity IT in time period T2. As mentioned before, the first and second ion intensities I1 and I2, as well as the total ion intensity IT, may be determined by averaging the respective intensity during the corresponding time period, calculating the mean during the time period, by determining the value in the middle of the time period (so, in the case of T1, at t=T1/2), or in another way. The results are depicted in FIG. 4B.

FIG. 4B shows the normalized first intensities I1/IT and normalized second intensities I2/IT respectively. For each time period T1, T2, etc., a normalized intensity I1/IT or I2/IT respectively has been determined. More specifically, a normalized intensity I1(T1)/IT(T1) is determined for the first time period T1, a further normalized intensity I2(T2)/IT(T2) is determined for the second time period T2, a still further normalized intensity I1(T3)/IT(T3) is determined for the third time period T3, etc. Then the ratio of these normalized intensities can be determined for each pair of adjacent time periods to provide a normalized ratio I1'/I2' for each of those pairs of time periods, where I1'=I1/IT and I2'=I2/IT. More specifically, the normalized ratio for the first pair of time periods, T1 and T2, is I1'(T1)/I2'(T2). Similarly, the normalized ratio for the second pair of time periods, T2 and T3, is I2'(T2)/I1'(T3). Thus, for each pair of adjacent time periods a common normalized ratio may be determined.

In FIG. 4C this normalized ratio I1'/I2' is represented for each pair of adjacent time periods at their border. As can be seen, this ratio is substantially constant over all time periods T1, T2, etc. Thus, the effect of fluctuations in the total ion beam intensity, as represented by the signal IT in FIG. 4A, on the ratio has been eliminated.

It is noted that in the example described above with reference to FIGS. 4A-4C, the ions are detected continuously. That is, the time periods T1, T2, T3, . . . etc. are contiguous time periods. Although contiguous time periods are advantageous as they minimize the total measurement time, they are not essential. In some embodiments, no detection could take place during a time period. In addition, the time periods may have equal durations, as illustrated in FIGS. 4A-4C, or have different durations. The duration of a time period may be, for example, be 10 ns or 1000 ms, or any suitable value in between.

In the example described above, only two different ion intensities I1 and I2 are determined. It will be understood that the invention can also be applied to more than two different ion types or ion ranges (that is, mass-to-charge ratio ranges). The invention can therefore also be applied when three, four, five, six or more different ion intensities I1, I2, I3, etc. are determined.

Figure 5:
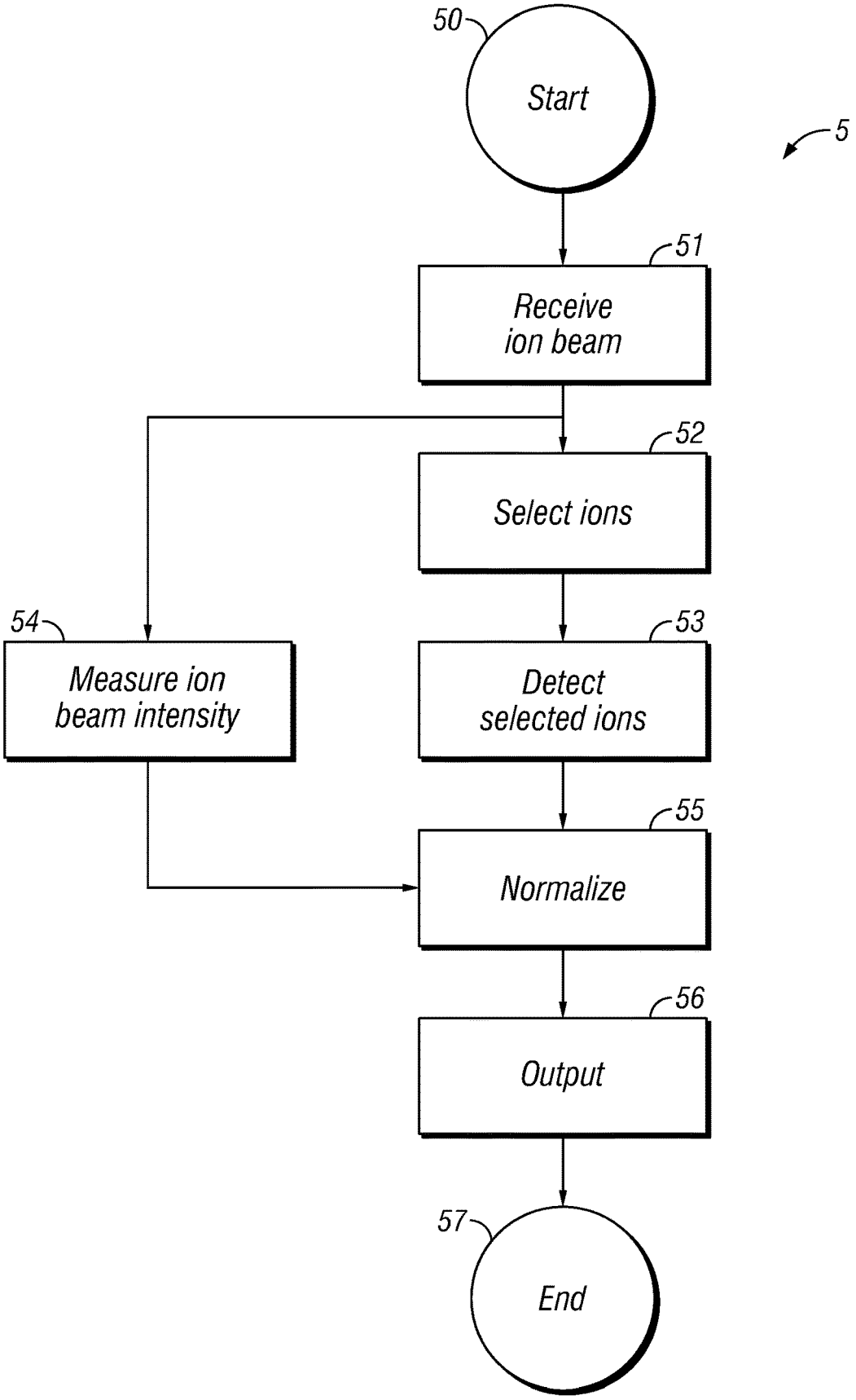
FIG. 5 schematically shows an exemplary embodiment of a method for operating a mass spectrometer according to the present invention.

An exemplary embodiment of a method in accordance with the invention is schematically illustrated in FIG. 5. The method 5 starts with initialization step 50. In step 51, an ion beam is received from an ion source. In step 52, ions having different ranges of mass-to-charge ratios are selected from the received ion beam, in two or more time periods. In step 53 ions within a selected range are detected in each of said time periods and first detection signals representative of quantities of detected ions having respective mass-to-charge ratios are produced. In step 54, a second detection signal representative of a total intensity of the ion beam received from the ion source as a function of time is produced, which may be done by measuring the total ion beam intensity. As can be seen, step 54 may be carried out in parallel with steps 52 and 53.

In step 55, the first detection signals are normalized by using the second detection signal. In step 56, normalized first detection signals are output. The method ends in step 57, although the method 5 can be seen as a continuous process which repeats itself.

Normalizing the first detection signals, at 55, may comprise dividing each first detection signal by the second detection signal in a corresponding time period. Normalizing the first detection signals, at 55, may further comprise dividing a normalized first signal corresponding with a first time period by a normalized first signal corresponding with a second, different time period corresponding with another ion intensity, to obtain a normalized intensity ratio. Step 55 may therefore comprise the sub steps of dividing each first detection signal by the second detection signal in a corresponding time period and dividing a normalized first signal corresponding with a first time period by a normalized first signal corresponding with a second, different time period corresponding with another ion intensity.

The method of the invention may further, at 52, comprise continuously selecting ions in consecutive time periods. In some embodiments, however, selecting ions may not take place in consecutive time periods.

The invention uses sequential detection of ion intensities. This does, however, not preclude the use of multiple detectors in the first detection unit. Thus, the first detection unit (13 in FIGS. 1 & 2) may include two, three or more detectors, which may for example each be designed for detecting a specific ion or range of ions. At least one of those detectors is used sequentially and the advantages of the present invention can therefore be obtained. In some embodiments, two or more detectors may be used alternatingly, for example, but this still constitutes sequential use of the detectors.

It will be understood by those skilled in the art that the invention is not limited to the embodiments shown and that many modifications and additions are possible without departing from the scope of the invention as defined in the appending claims.

The invention claimed is:

1. A mass spectrometer comprising:

a mass analyzer for selecting from an ion beam, in two or more time periods, ions having different ranges of mass-to-charge ratios;

a first detector configured to detect, in each of said time periods, ions within a respective selected range of mass-to-charge ratios and producing first detection signals representative of quantities of detected ions having the respective ranges of mass-to-charge ratios;

a second detector configured to produce a second detection signal representative of a total intensity of the ion beam as a function of time; and a processing circuit configured to:

cause the mass analyzer to operate in a first mode where the mass analyzer selects for ions having a first selected range of mass-to-charge ratios;

cause the mass analyzer to operate in a second mode where the mass analyzer selects for ions having a second selected range of mass-to-charge ratios; and normalize the first detection signals by using the second detection signal; and obtaining a normalized intensity ratio by dividing:

a first normalized first signal corresponding with a first time period where the mass analyzer was operating in the first mode; by a second normalized first signal corresponding with a second, different time period where the mass analyzer was operating in the second mode.

2. The mass spectrometer according to claim 1, wherein the processing circuit is further configured for causing the mass analyzer to cycle between at least the first mode of operation and the second mode of operation, and for producing a ratio of normalized first detection signals for a plurality of such cycles.

3. The mass spectrometer according to claim 1, wherein the processing circuit is configured for normalizing the first detection signals by dividing each first detection signal by the second detection signal at a corresponding time period.

4. The mass spectrometer according to claim 1, wherein the first detector comprises a single detector.

5. The mass spectrometer according to claim 1, wherein the mass analyzer is configured for continuously selecting ions in consecutive time periods.

6. The mass spectrometer according to claim 1, wherein the second detector comprises a detection element arranged upstream of the mass analyzer.

7. The mass spectrometer according to claim 6, wherein the detection element comprises a skimmer, an entrance slit, an aperture or an ion lens.

8. The mass spectrometer according to claim 6, wherein the second detector comprises a detection circuit for deriving the second detection signal from an electrical current generated in the detection element by ions from the ion beam.

9. The mass spectrometer according to claim 1, further comprising an ion source for producing the ion beam.

10. The mass spectrometer according to claim 9, wherein the ion source comprises a plasma source.

11. The mass spectrometer according to claim 10, further comprising ion optics for removing plasma gas ions, which ion optics are arranged upstream of a detection element of the second detector.

12. The mass spectrometer according to claim 10, further comprising a pre-mass filter for removing plasma gas ions, which pre-mass filter is arranged upstream of the detection element.

13. The mass spectrometer according to claim 9, wherein the ion source comprises a thermal ionization source or an electron impact source.

14. A method of operating a mass spectrometer comprising:

receiving an ion beam from an ion source;

selecting from the received ion beam, in two or more time periods, ions having different ranges of mass-to-charge ratios, the two or more time periods comprising:

a first time period where ions having a first selected range of mass-to-charge ratios are selected; and a second, different time period where ions having a second, different selected range of mass-to-charge ratios are selected;

detecting, in each of said time periods, ions within a respective selected range of mass-to-charge ratios and producing first detection signals representative of quantities of detected ions having respective ranges of mass-to-charge ratios;

detecting, in each of said time periods, a total intensity of the ion beam so as to produce a second detection signal;

normalizing the first detection signals by using the second detection signal; and obtaining a normalized intensity ratio by dividing:

a first normalized first signal corresponding with the first time period where ions having the first selected range of mass-to-charge ratios was selected; by a second normalized first signal corresponding with the second, different time period where ions having the second, different selected range of mass-to-charge ratios was selected.

15. The method according to claim 14, wherein normalizing the first detection signals comprises dividing each first detection signal by the second detection signal at a corresponding time period.

16. The method according to claim 14, further comprising dividing a normalized first signal corresponding with a first time period by a normalized first signal corresponding with a second, different time period to obtain a normalized intensity ratio.

17. The method according to claim 14, further comprising continuously selecting ions in consecutive time periods.

18. The method according to claim 14, further comprising:

removing plasma gas ions prior to selecting, in two or more time periods, ions having different ranges of mass-to-charge ratios.

19. The method according to claim 14, wherein the two or more time periods further comprising a third, different time period where ions having the first selected range of mass-to-charge ratios are selected, and a fourth, different time period where ions having the second selected range of mass-to-charge ratios are selected, and the method further comprising:

obtaining an additional normalized intensity ratio by dividing:

a third normalized first signal corresponding with the third time period where ions having the first selected range of mass-to-charge ratios was selected; by a fourth normalized first signal corresponding with the fourth time period where ions having the second selected range of mass-to-charge ratios was selected.

20. A computer program product comprising one or more non-transitory computer-readable media having computer instructions stored therein, the computer program instructions being configured such that, when executed by one or more computing devices, the computer program instructions cause the one or more computing devices to:

identify an ion beam from an ion source;

select from the ion beam, in two or more time periods, ions having different ranges of mass-to-charge ratios, the two or more time periods comprising:

a first time period where ions having a first selected range of mass-to-charge ratios are selected; and a second, different time period where ions having a second, different selected range of mass-to-charge ratios are selected;

detect, in each of said time periods, ions within a respective selected range of mass-to-charge ratios and producing first detection signals representative of quantities of detected ions having respective ranges of mass-to-charge ratios;

detect, in each of said time periods, a total intensity of the ion beam so as to produce a second detection signal;

normalize the first detection signals by using the second detection signal; and, including obtaining a normalized intensity ratio by dividing:

a first normalized first signal corresponding with the first time period; by a second normalized first signal corresponding with the second, different time period.

* * * * *